US009828829B2

(12) United States Patent
Frisby et al.

(10) Patent No.: US 9,828,829 B2
(45) Date of Patent: Nov. 28, 2017

(54) INTERMEDIATE COMPLETION ASSEMBLY FOR ISOLATING LOWER COMPLETION

(75) Inventors: Raymond A. Frisby, Houston, TX (US); Jeffrey S. Phillips, The Woodlands, TX (US); Roy N. Nelson, Houston, TX (US); Donald Lauderdale, Cypress, TX (US)

(73) Assignee: BAKER HUGHES, a GE company, LLC, Houston, TX (US)

( * ) Notice: Subject to any disclaimer, the term of this patent is extended or adjusted under 35 U.S.C. 154(b) by 126 days.

(21) Appl. No.: 13/434,091

(22) Filed: Mar. 29, 2012

(65) Prior Publication Data

US 2013/0255947 A1 Oct. 3, 2013

(51) Int. Cl.

| | |
|---|---|
| ***E21B 34/06*** | (2006.01) |
| ***E21B 33/13*** | (2006.01) |
| ***E21B 33/12*** | (2006.01) |
| ***E21B 34/10*** | (2006.01) |
| ***E21B 43/14*** | (2006.01) |

(52) U.S. Cl.

CPC ..... *E21B 33/13* (2013.01); *E21B 33/12* (2013.01); *E21B 34/06* (2013.01); *E21B 34/10* (2013.01); *E21B 43/14* (2013.01)

(58) Field of Classification Search

CPC ..... E21B 34/06

USPC ..... 166/373, 386, 332.4, 332.5, 242.6, 322, 166/332.1, 381, 387, 193, 334.1, 378, 117

See application file for complete search history.

(56) References Cited

U.S. PATENT DOCUMENTS

| | | | | |
|---|---|---|---|---|
| 3,493,052 A | | 2/1970 | Evans et al. | |
| 4,274,486 A | | 6/1981 | Fredd | |
| 4,382,623 A | | 5/1983 | Richardson | |
| 4,942,926 A | | 7/1990 | Lessi | |
| 5,058,682 A | | 10/1991 | Pringle | |
| 5,311,939 A | * | 5/1994 | Pringle et al. | 166/134 |
| 5,372,193 A | | 12/1994 | French | |
| 5,465,787 A | | 11/1995 | Roth | |
| 5,831,156 A | | 11/1998 | Mullins | |
| 5,865,251 A | | 2/1999 | Rebardi et al. | |

(Continued)

OTHER PUBLICATIONS

Martin P. Coronado et al., "Advanced Openhole Completions Utilizing a Simplified Zone Isolation System"; Socity of Petroleum Engineers, SPE Paper No. 77438; Sep. 29, 2002.

(Continued)

*Primary Examiner* — George Gray

(74) *Attorney, Agent, or Firm* — Cantor Colburn LLP

(57) ABSTRACT

A completion system includes a lower completion installed in a borehole proximate to a downhole formation. An intermediate completion assembly is included directly engaged with the lower completion. The intermediate completion assembly includes a barrier valve and packer device. The barrier valve is operatively arranged to selectively impede fluid flow through the lower completion and the packer device operatively arranged for isolating the formation. An upper completion string is included that is selectably engagable with the intermediate completion assembly. The barrier valve is operatively arranged to be transitionable to an open position when engaged with the upper completion string and transitions to a closed position via the upper completion string when the upper completion string is pulled out of the borehole. A method of completing a borehole is also included.

13 Claims, 8 Drawing Sheets

(56) References Cited

U.S. PATENT DOCUMENTS

| | | | | |
|---|---|---|---|---|
| 5,875,852 | A | 3/1999 | Floyd et al. | |
| 6,302,216 | B1 | 10/2001 | Patel | |
| 6,352,119 | B1 | 3/2002 | Patel | |
| 6,491,102 | B2 | 12/2002 | Leismer et al. | |
| 6,516,886 | B2 | 2/2003 | Patel | |
| 6,598,675 | B2 | 7/2003 | Bussear et al. | |
| 6,675,893 | B2 | 1/2004 | Lund | |
| 6,684,950 | B2 | 2/2004 | Patel | |
| 6,695,049 | B2 | 2/2004 | Ostocke et al. | |
| 7,152,688 | B2 | 12/2006 | Richards | |
| 7,219,743 | B2 | 5/2007 | Wolters et al. | |
| 7,228,914 | B2 * | 6/2007 | Chavers et al. | 166/386 |
| 7,322,422 | B2 | 1/2008 | Patel | |
| 7,380,609 | B2 * | 6/2008 | Page et al. | 166/387 |
| 7,428,924 | B2 | 9/2008 | Patel | |
| 7,430,153 | B2 | 9/2008 | Fraser et al. | |
| 7,487,830 | B2 | 2/2009 | Wolters et al. | |
| 7,617,876 | B2 | 11/2009 | Patel et al. | |
| 7,640,977 | B2 | 1/2010 | Jonas | |
| 7,775,275 | B2 | 8/2010 | Patel | |
| 7,896,079 | B2 | 3/2011 | Dyer et al. | |
| 7,950,454 | B2 | 5/2011 | Patel et al. | |
| 8,056,628 | B2 | 11/2011 | Whitsitt et al. | |
| 8,231,947 | B2 | 7/2012 | Vaidya et al. | |
| 8,286,713 | B2 | 10/2012 | Broussard | |
| 8,353,353 | B2 | 1/2013 | Reaux | |
| 8,813,855 | B2 | 8/2014 | Lake | |
| 2003/0150622 | A1 | 8/2003 | Patel et al. | |
| 2003/0211768 | A1 | 11/2003 | Cameron et al. | |
| 2004/0159444 | A1 | 8/2004 | Wolters et al. | |
| 2005/0092501 | A1 | 5/2005 | Chavers et al. | |
| 2005/0095156 | A1 | 5/2005 | Wolters et al. | |
| 2005/0126789 | A1 | 6/2005 | Nivens et al. | |
| 2005/0230122 | A1 * | 10/2005 | Cho et al. | 166/381 |
| 2006/0151183 | A1 | 7/2006 | Turner | |
| 2007/0084607 | A1 | 4/2007 | Wright et al. | |
| 2007/0119599 | A1 | 5/2007 | Chavers et al. | |
| 2007/0227727 | A1 | 10/2007 | Patel et al. | |
| 2007/0235185 | A1 | 10/2007 | Patel et al. | |
| 2007/0295504 | A1 | 12/2007 | Patel et al. | |
| 2008/0223585 | A1 | 9/2008 | Patel et al. | |
| 2009/0025923 | A1 | 1/2009 | Patel et al. | |
| 2009/0078429 | A1 | 3/2009 | Du et al. | |
| 2009/0218104 | A1 | 9/2009 | Brown | |
| 2010/0206579 | A1 | 8/2010 | Guven et al. | |
| 2010/0236774 | A1 | 9/2010 | Patel et al. | |
| 2010/0270031 | A1 | 10/2010 | Patel | |
| 2010/0300702 | A1 | 12/2010 | Andrews et al. | |
| 2011/0192596 | A1 | 8/2011 | Patel | |
| 2011/0226479 | A1 | 9/2011 | Tippel et al. | |
| 2012/0138309 | A1 | 6/2012 | Lake | |
| 2012/0255738 | A1 | 10/2012 | Lauderdale et al. | |
| 2012/0261137 | A1 | 10/2012 | Martinez et al. | |
| 2013/0075108 | A1 | 3/2013 | Frisby et al. | |
| 2013/0075109 | A1 | 3/2013 | Frisby et al. | |
| 2013/0087344 | A1 | 4/2013 | Reid et al. | |
| 2013/0255946 | A1 | 10/2013 | Frisby et al. | |
| 2013/0255947 | A1 | 10/2013 | Frisby et al. | |
| 2013/0255958 | A1 | 10/2013 | Frisby et al. | |
| 2013/0255961 | A1 | 10/2013 | Frisby et al. | |
| 2013/0306316 | A1 | 11/2013 | Patel | |

OTHER PUBLICATIONS

Notification of Transmittal of the International Search Report and the Written Opinion of the International Searching Authority; PCT/US2011/063519; dated Jul. 30, 2012; Korean Intellecutal Property Office; 8 pages.

L. Izquierdo et all, "Managing the Retrieval of Triple-Zone Intelligent Completions in Extended-Reach Wells Offshore California"; Society of Petroleum Engineers, SPE Paper No. 112115; Mar. 4, 2008.

Dwayne Leismer, "A System Approach to Annular Control for Total Well Safety"; Offshore Technology Conference; Paper No. OTC 7349; May 3, 1993.

Notification of Transmittal of the International Search Report and the Written Opinion of the International Searching Authority; PCT/US2011/060168; dated Jun. 29, 2012; Korean Intellectual Property Office; 10 pages.

K. Munday et al., "Want to Make Tree Operations Safer? Why Not Use the DHSV as a Barrier?"; Society of Petroleum Engineers, SPE Paper No. 96337; Sep. 24, 2006.

T.A. Nassereddin et al., "Electromagnetic Surface-Controlled Sub-Surface Safety Valve: An Immediate Soluation to Secure Wells with Damaged Control Line"; Society of Petroleum Engineers, SPE Paper No. 138356; Nov. 1, 2010.

Great Britain Search Report for GB Application No. 1303095.2, dated Jun. 24, 2013, pp. 1-5.

International Search Report and Written Opinion for PCT Application No. PCT/US2013/06856, dated May 30, 2013, pp. 1-14.

* cited by examiner

INTERMEDIATE COMPLETION ASSEMBLY FOR ISOLATING LOWER COMPLETION

BACKGROUND

Current practice for completing downhole structures, particularly deepwater wells, involves stimulating, hydraulic fracturing, frac packing and/or gravel packing one or more zones and then landing a fluid isolation valve, typically a ball valve system, above the treated zones. The fluid isolation valve temporarily blocks fluid flow so that an upper completion string can be run and connect the treated zones to surface for enabling production after the fluid isolation valve is opened. Although such systems do generally work for their intended purposes, they are not without limitations. For example, these known ball-type fluid isolation valves do not provide an efficient and reliable system for periodically replacing portions of the upper completion, and may require wireline intervention, hydraulic pressuring, or the running and/or manipulation of a designated tool to control the fluid isolation valve. For example, artificial lift systems (e.g., electric submersible pumping systems or ESPs), are increasingly desirable, particularly for use in deepwater wells. Accordingly, advances in downhole valve technology, at times referred to as "mechanical barriers", particularly for deepwater wells and/or for enabling more reliable and efficient replacement of upper completion systems and components, are always well received by the industry.

SUMMARY

A completion system, including a lower completion installed in a borehole proximate to a downhole formation; an intermediate completion assembly directly engaged with the lower completion, the intermediate completion assembly including a barrier valve and packer device, the barrier valve operatively arranged to selectively impede fluid flow through the lower completion, the packer device operatively arranged for isolating the formation; and an upper completion string selectably engagable with the intermediate completion assembly, the barrier valve operatively arranged to be transitionable to an open position when engaged with the upper completion string and transitioning to a closed position via the upper completion string when the upper completion string is pulled out of the borehole.

A method of completing a borehole including running a lower completion in the borehole proximate to a downhole formation; engaging an intermediate completion assembly directly with the lower completion; impeding fluid flow through the lower completion selectively with a barrier valve of the intermediate completion assembly prior to producing through the completion, the barrier valve operatively arranged to be transitionable to an open position when engaged with an upper completion string and transitioning to a closed position via the upper completion string when the upper completion string is pulled out of the borehole; and isolating the formation with a packer device of the intermediate completion assembly prior to producing through the completion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
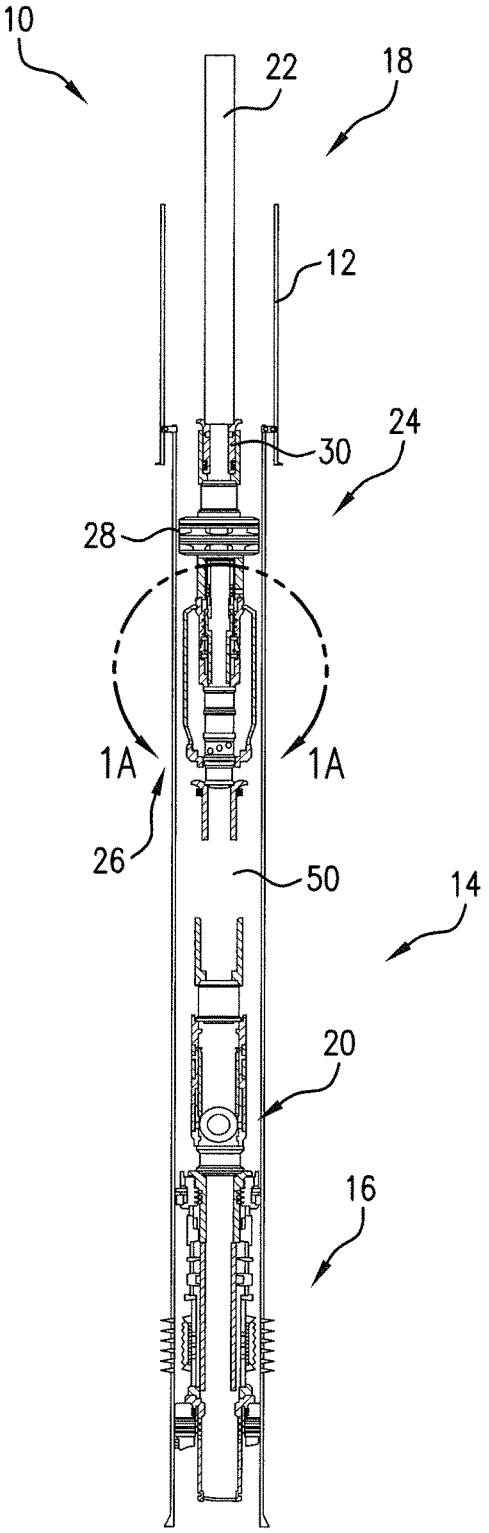
FIG. 1 is a partial cross-sectional view of a completion system in which an intermediate assembly is being engaged with a lower completion.

Referring now to FIG. 1, a completion system 10 is shown installed in a borehole 12 (cased, lined, open hole, etc.). The system 10 includes a lower completion 14 including a gravel or frac pack assembly 16 (or multiples thereof for multiple producing zones) that is isolated from an upper completion 18 of the system 10 by a fluid loss or fluid isolation valve 20. The gravel or frac pack assembly 16 and the valve 20 generally resemble those known and used in the art. That is, the gravel or frac pack assembly 16 enables the fracturing of various zones while controlling sand or other downhole solids, while the valve 20 takes the form of a ball valve that is transitionable between a closed configuration (shown in FIG. 1) and an open configuration (discussed later) due to cycling the pressure experienced by the valve 20 or other mechanical means, e.g., through an intervention with wireline or tubing. Of course, known types of fluid loss valves other than ball valves could be used in place of the valve 20. Additionally, it is to be appreciated that the lower completion 14 could include components and assemblies other than, or in addition to, the frac pack and/or gravel pack assembly 16, such as for enabling stimulation, hydraulic fracturing, etc.

Figure 1A:
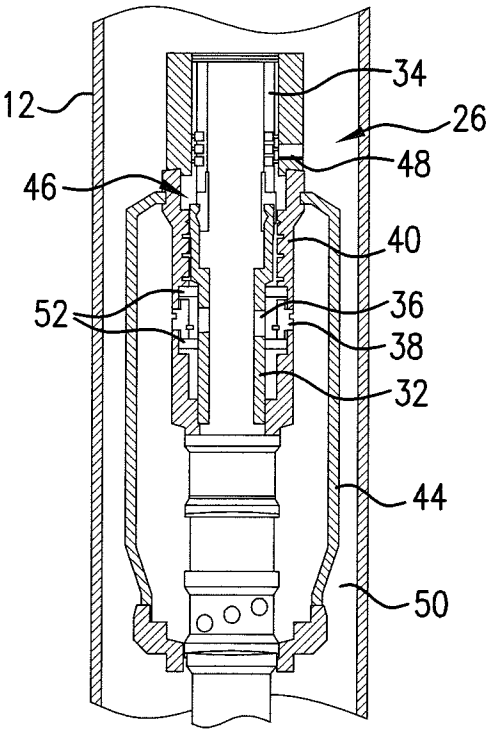
FIG. 1A is an enlarged view of the area circled in FIG. 1.

The system 10 also includes a work string 22 that enables an intermediate completion assembly 24 to be run in. Essentially, the assembly 24 is arranged for functionally replacing the valve 20. That is, while the valve 20 remains physically downhole, the assembly 24 assumes or otherwise takes off at least some functionality of the valve 20, i.e., the assembly 24 provides isolation of the lower completion 14 and the formation and/or portion of the borehole 12 in which the lower completion 14 is positioned. Specifically, in the illustrated embodiment, the assembly 24 in the illustrated embodiment is a fluid loss and isolation assembly and includes a barrier valve 26 and a production packer or packer device 28. By packer device, it is generally meant any assembly arranged to seal an annulus, isolation a formation or portion of a borehole, anchor a string attached thereto, etc. The barrier valve 26 is shown in more detail in FIG. 1A. Initially, as shown in FIGS. 1 and 1A, a shifting tool 30 holds a sleeve 32 of the barrier valve 26 in an open position by an extension 34 of the shifting tool 30 that extends through the packer 28. The term "shifting tool" is used broadly and encompasses seal assemblies and devices that allow relative movement or shifting of the sleeve 32 other than the tool 30 as illustrated. When the sleeve 32 is in its open position, a set of ports 36 in the sleeve 32 are axially aligned with a set of ports 38 in a housing or body 40 of the barrier valve 26, thereby enabling fluid communication through the barrier valve 26. Of course, movement of the sleeve 32 for enabling fluid communication is not limited to axial, although this direction of movement conveniently corresponds with the direction of movement of the work string 22. In the illustrated embodiment, a shroud 44 is radially disposed with the barrier valve 26 for further controlling and/or regulating the flow rate, pressure, etc. of fluid, i.e., by redirecting fluid flow from the lower completion 14 out into the chamber formed by the shroud 44, and back into the barrier valve 26 via the ports 36 and 38 when the valve 26 is open. In the illustrated embodiment, the extension 34 of the shifting tool 30 (and/or the sleeve 32) includes a releasable connection 46 for enabling releasable or selective engagement between the tool 30 and the sleeve 32. For example, the connection 46 could be formed by a collet, spring-loaded or biased fingers or dogs, etc.

Figure 2:
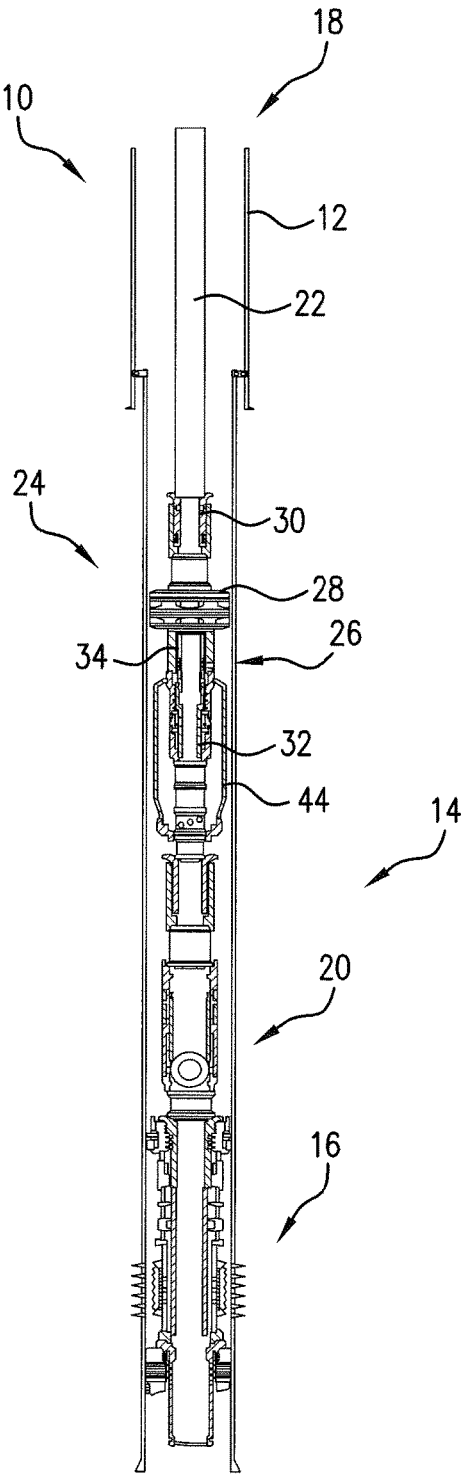
FIG. 2 is a partial cross-sectional view of the completion system of FIG. 1 in which the intermediate assembly is engaged with the lower completion.

A method of assembling and using the completion 10 according to one embodiment is generally described with respect to FIGS. 1-9. As illustrated in FIG. 1, the work string 22 with the assembly 24 is initially run in for connection to the lower completion 14, thereby providing a fluid pathway to surface and enabling production. For example, while circulating fluids in the borehole 12, the assembly 24 can be properly positioned by lowering the work string 22 until circulation stops. After noting the location and slacking off on the work string, the assembly 24 is landed at the lower completion 14, as shown in FIG. 2. Once landed at the lower completion 14, the production packer 28 is set, e.g., via hydraulic pressure in the work string 22, thereby isolating and anchoring the assembly 24. At this point, the barrier valve 26 is open and an equalizing port 48 between the interior of the work string 22 and an annulus 50 is closed by the extension 34 of the shifting tool 30.

Figure 3A:
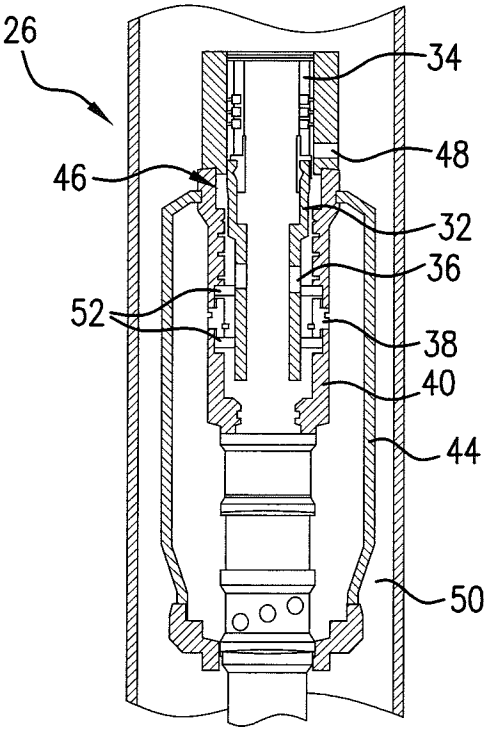
FIG. 3A is an enlarged view of the area circled in FIG. 3.
Figure 3:
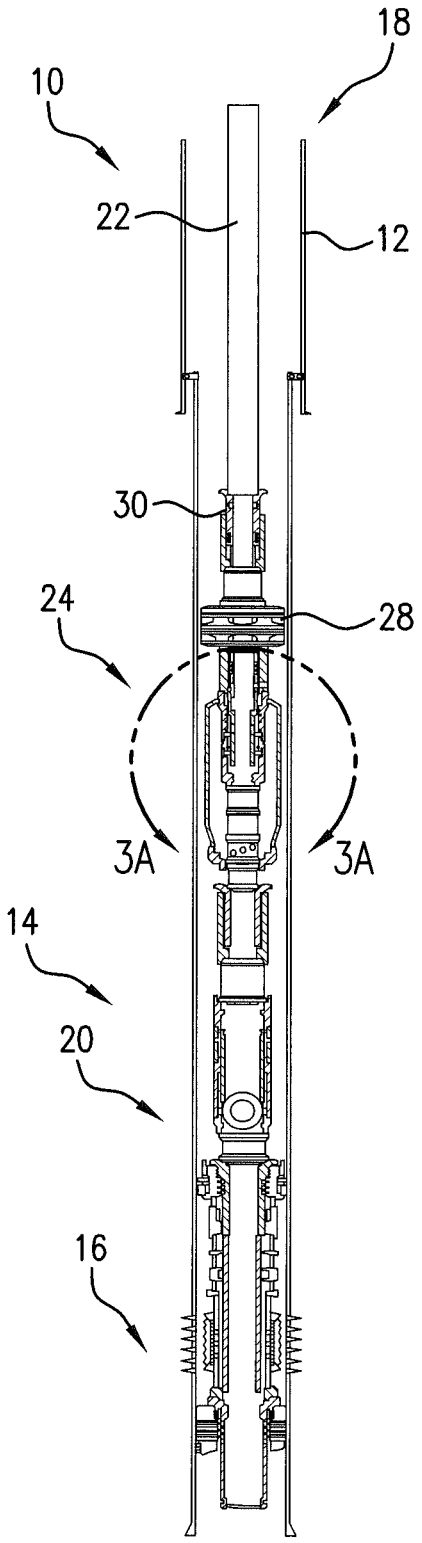
FIG. 3 is a partial cross-sectional view of the completion system of FIG. 1 in which a barrier valve of the intermediate assembly is closed for testing a packer of the intermediate assembly.
Figure 4:
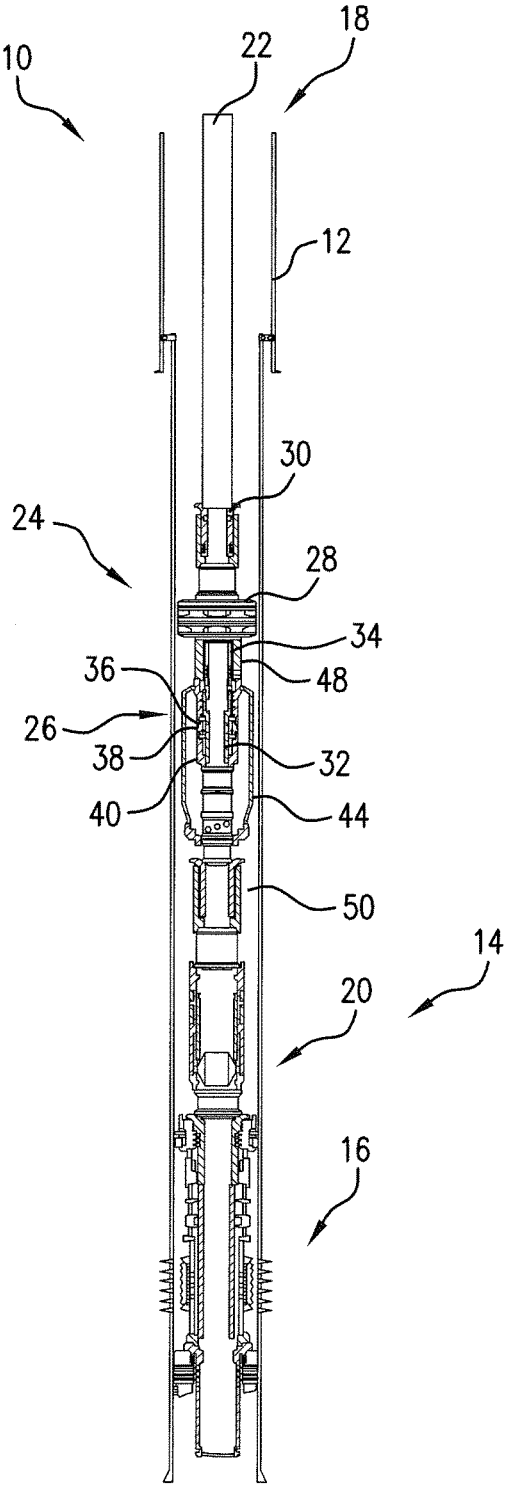
FIG. 4 is a partial cross-sectional view of the completion system of FIG. 1 in which a fluid isolation valve for the lower completion is opened.

As illustrated in FIG. 3, the work string 22 can then be pulled out in order to axially misalign the ports 36 and 38, which closes the barrier valve 26. That is, as shown in more detail in FIG. 3A, communication through the port 38 and into the barrier valve 26 is prevented by a pair of seal elements 52 sealed against the sleeve 32. As also shown in more detail in FIG. 3A, pulling out the work string 22 slightly also opens the equalizing port 48, enabling the packer 28 to be tested on the annulus 50 and/or down the work string 22.

Figure 5:
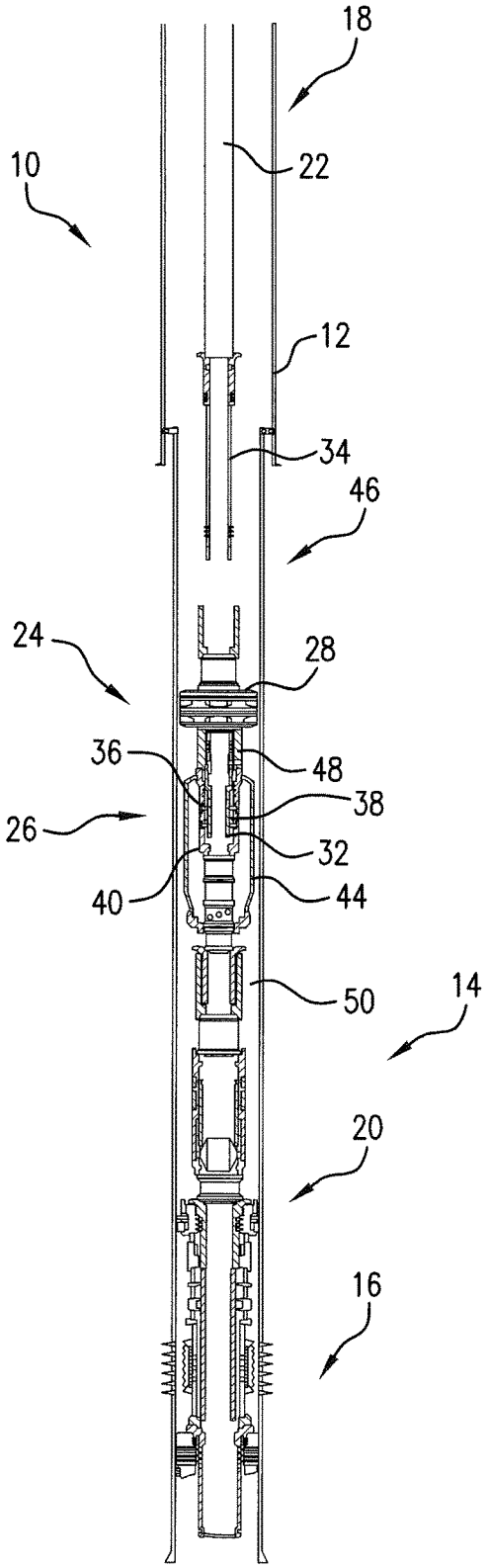
FIG. 5 is a partial cross-sectional view of the completion system of FIG. 1 in which a work string on which the intermediate assembly was run-in is pulled out, thereby closing the barrier valve of the intermediate assembly.

As depicted in FIG. 4, by again slacking off on the work string 22, the barrier valve 26 re-opens (e.g., taking the configuration shown in FIG. 1A) and pressure can be cycled in the work string 22 for opening the fluid loss valve 20. Next, as shown in FIG. 5, the work string 22 is pulled out of the borehole 12. Pulling out the work string 22 first shifts the sleeve 32 into its closed position (e.g., as shown in FIG. 3A) for the barrier valve 26. Then due to the packer 28 anchoring the assembly 14, continuing to pull out the work string 22 disconnects the tool 30 from the sleeve 32 at the releasable connection 46.

Figure 6:
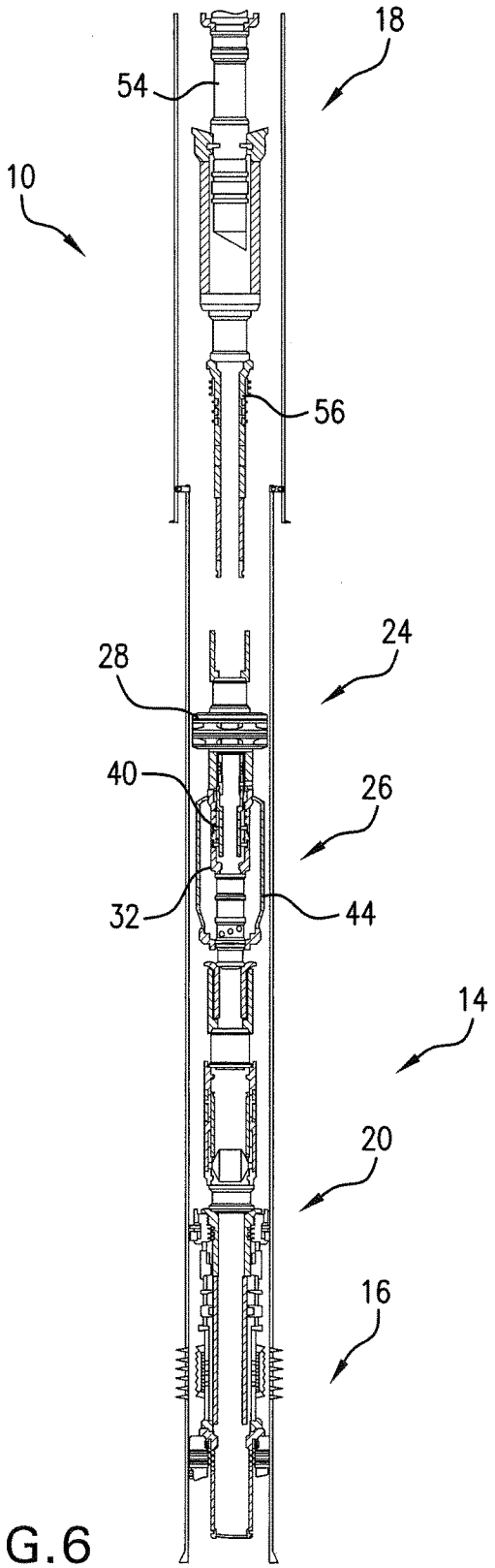
FIG. 6 is a partial cross-sectional view of the completion system of FIG. 1 in which a production string is being run-in for engagement with the intermediate assembly.
Figure 7:
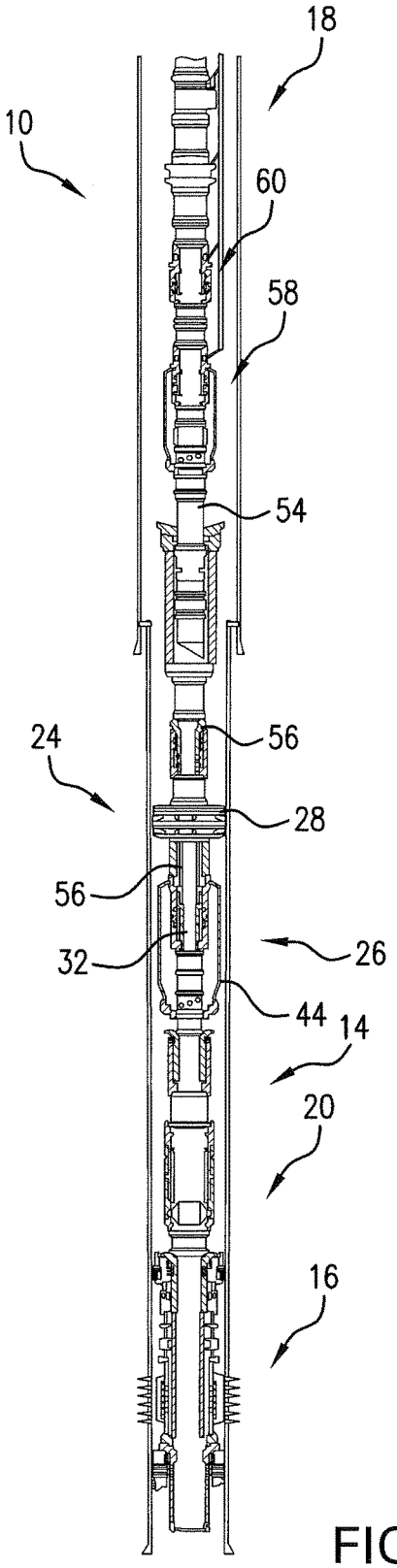
FIG. 7 is a partial cross-sectional view of the completion system of FIG. 1 in which the production string is engaged with the intermediate assembly for opening the barrier valve and enabling production from the lower completion.

In order to start production, a production string 54 is run and engaged with the assembly 24 as shown in FIGS. 6 and 7. The production string 54 includes a shifting tool 56 similar to the tool 30, i.e., arranged with a releasable connection to selectively open and close the barrier valve 26 by manipulating the sleeve 32. In this way, the production string 54 is first landed at the assembly 24 and the tool 30 extended through the packer 28 for shifting the sleeve 32 to open the barrier valve 26. Once the barrier valve 26 is opened, a tubing hanger supporting the production string 54 is landed and fluid from the downhole zones, i.e., proximate to the frac or gravel pack assembly 16, can be produced. In the illustrated embodiment the production string 54 takes the form of an artificial lift system, particularly an ESP system for a deepwater well, which are generally known in the art. However, it is to be appreciated that the current invention as disclosed herein could be used in non-deepwater wells, without artificial lift systems, with other types of artificial lift systems, etc.

Workovers are a necessary part of the lifecycle of many wells. ESP systems, for example, are typically replaced about every 8-10 years, or some other amount of time. Other systems, strings, or components in the upper completion 18 may need to be similarly removed or replaced periodically, e.g., in the event of a fault, damage, corrosion, etc. In order to perform the workover, reverse circulation may be performed by closing a circulation valve 58 and shifting open a hydraulic sliding sleeve 60 of the production string 54. Advantageously, if the production string 54 or other portions in the upper completion 18 (i.e., up-hole of the assembly 24) needs to be removed, removal of that portion will "automatically" revert the barrier valve 26 to its closed position, thereby preventing fluid loss. That is, the same act of pulling out the upper completion string, e.g., the production string 54, the work string 22, etc., will also shift the sleeve 32 into its closed position and isolate the fluids in the lower completion. This eliminates the need for expensive and additional wireline intervention, hydraulic pressure cycling, running and/or manipulating a designated shifting tool, etc. The packer 28 also remains in place to maintain isolation. This avoids the need for expensive and time consuming processes, such as wireline intervention, which may otherwise be necessary to close a fluid loss valve, e.g., the valve 20.

Figure 8:
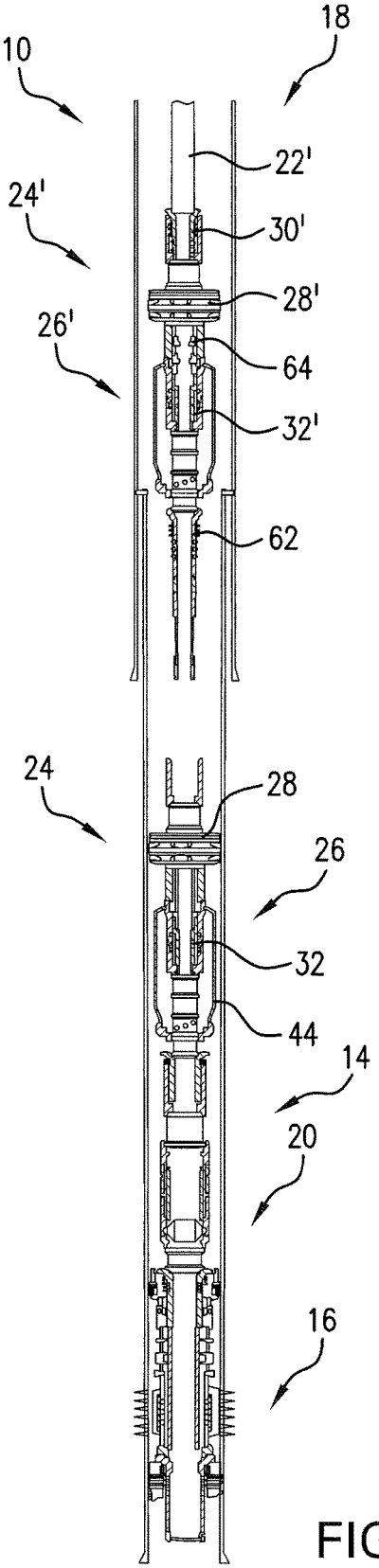
FIG. 8 is a partial cross-sectional view of the completion system of FIG. 1 in which the production string has been pulled out, thereby closing the barrier valve of the intermediate assembly and a subsequent intermediate assembly is being run-in for engagement with the original intermediate assembly.
Figure 9:
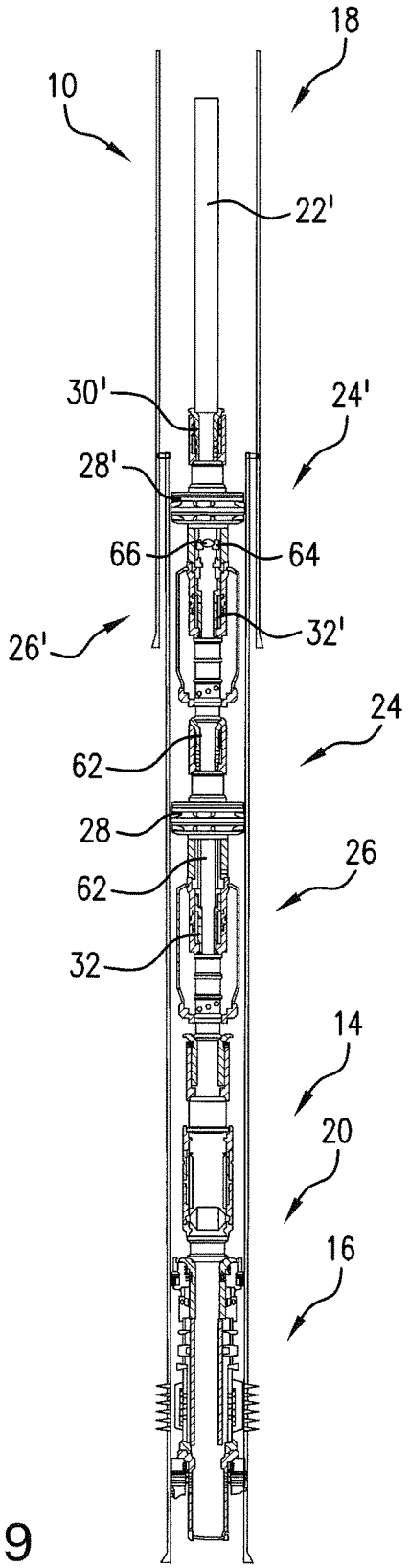
FIG. 9 is a partial cross-sectional view of the completion system of FIG. 1 in which the subsequent intermediate assembly is stacked on the original intermediate assembly.

A replacement string, e.g., a new production string resembling the string 54, can be run back down into the same intermediate completion assembly, e.g., the assembly 24. Alternatively, if a long period of time has elapsed, e.g., 8-10 years as indicated above with respect to ESP systems, it may instead be desirable to run in a new intermediate completion assembly, as equipment wears out over time, particularly in the relatively harsh downhole environment. For example, as shown in FIGS. 8 and 9 an additional or subsequent intermediate completion assembly 24' is run in on a work string 22' for engagement with the original assembly 24. As noted above with respect to the valve 20, the subsequent assembly 24' essentially functionally replaces the original assembly 24. That is, the subsequent assembly 24' substantially resembles the original assembly 24, including a barrier valve 26' for preventing fluid loss, a production packer 28' for reestablishing isolation, and a sleeve 32' that is manipulated by a shifting tool 30' on the work string 22'. It should be appreciated that the aforementioned components associated with the assembly 24' include prime symbols, but otherwise utilize the same base reference numerals as corresponding components described above with respect to the assembly 24, and the above descriptions generally apply to the corresponding components having prime symbols and of the assembly 24' (even if unlabeled), unless otherwise noted.

Unlike the assembly 24, the assembly 24' has a shifting tool 62 for shifting the sleeve 32 of the original assembly 24 in order to open the barrier valve 26, which was closed by the shifting tool 56 when the production string 54 was pulled out. As long as the assembly 24' remains engaged with the assembly 24, the tool 62 will mechanically hold the barrier valve 26 in its open position. In this way, the assembly 24' can be stacked on the assembly 24 and the barrier valve 26' will essentially take over the fluid loss functionality of the barrier valve 26 of the assembly 24 by holding the barrier valve 26 open with the tool 62. It is to be appreciated that any number of these subsequent assemblies 24' could continue to be stacked on each other as needed. For example, a new one of the assemblies 24' could be stacked onto a previous assembly between the acts of pulling out an old upper completion or production string and running in a new one. In this way, the newly run upper completion or production string will interact with the uppermost of the assemblies 24' (as previously described with respect to the assembly 24 and the production string 54), while all the other intermediate assemblies are held open by the shifting tools of the subsequent assemblies (as previously described with respect to the assembly 24 and the shifting tool 62).

The shifting tool 30' also differs from the shifting tool 30 to which it corresponds. Specifically, the shifting tool 30' includes a seat 64 for receiving a ball or plug 66 that is dropped and/or pumped downhole. By blocking flow through the seat 64 with the plug 66, fluid pressure can be built up in the work string 22' suitable for setting and anchoring the production packer 28'. That is, pressure was able to be established for setting the original packer 28 because the fluid loss valve 20 was closed, but with respect to FIGS. 8 and 9 the valve 20 has since been opened and fluid communication established with the lower completion 14 as described previously.

After setting the packer 28', the string 22' can be pulled out, thereby automatically closing the sleeve 32' of the barrier valve 26' as previously described with respect to the assembly 24 and the work string 22 (e.g., by use of a releasable connection). As previously noted, the original barrier valve 26 remains opened by the shifting tool 62 of the subsequent assembly 24'. As the assembly 24' has essentially taken over the functionality of the original assembly 24 (i.e., by holding the barrier valve 26 constantly open with the tool 62), a new production string, e.g., resembling the production string 54, can be run in essentially exactly as previously described with respect to the production string 54 and the assembly 24, but instead engaged with the assembly 24'. That is, instead of manipulating the barrier valve 26, the shifting tool (e.g., resembling the tool 56) of the new production string (e.g., resembling the string 54) will shift the sleeve 32' of the barrier valve 26' open for enabling production of the fluids from the downhole zones or reservoir.

It is again to be appreciated that any number of the assemblies 24' can continue to be run in and stacked atop one another. For example, this stacking of the assemblies 24' can occur between the acts of pulling out an old production string and running a new production string, with the pulling out of each production string "automatically" closing the uppermost one of the assemblies 24' and isolating the fluid in the lower completion 14. In this way, any number of production strings, e.g., ESP systems, can be replaced over time without the need for expensive and time consuming wireline intervention, hydraulic pressure cycling, running and/or manipulation of a designated shifting tool, etc. Additionally, the stackable nature of the assemblies 24, 24', etc., enables the isolation and fluid loss hardware to be refreshed or renewed over time in order to minimize the likelihood of a part failure due to wear, corrosion, aging, etc.

Figure 10:
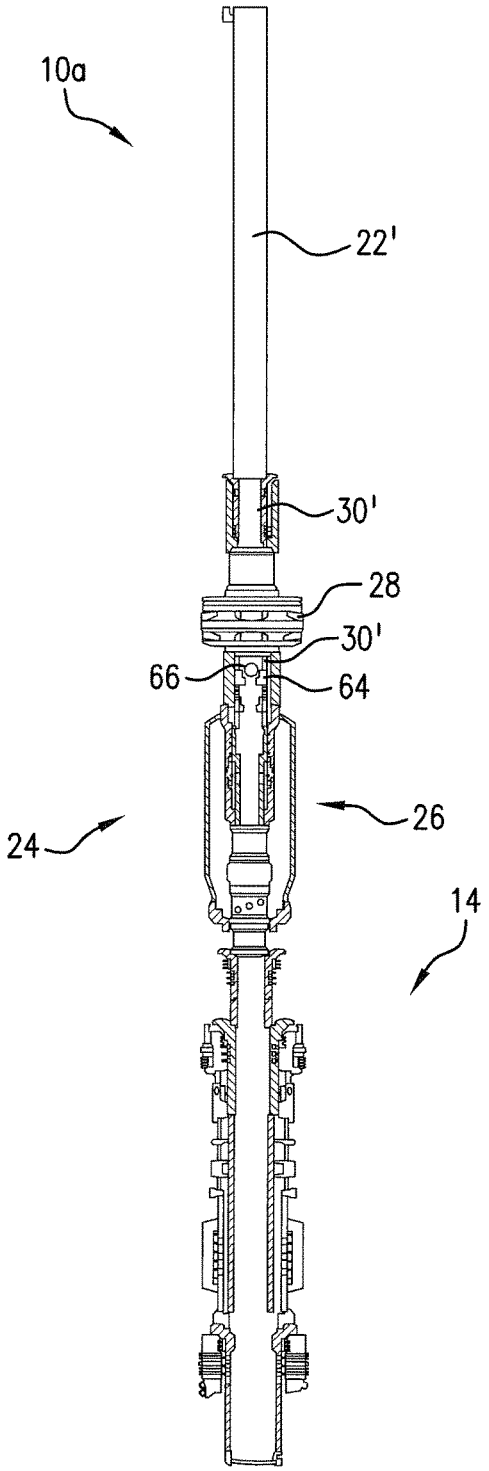
FIG. 10 is a partial cross-sectional view of a completion system according to another embodiment disclosed herein.

It is noted that the fluid loss valve 20 can be substituted, for example, by the assembly 24 being run in on a work string resembling the work string 22' as opposed to the work string 22. For example, as shown in FIG. 10, a modified system 10*a* includes the assembly 24 being run in on the work string 22'. In this way, fluid pressure suitable for setting the original packer 28 can be established by use of the ball seat 64 and the plug 66 instead of the valve 20. Accordingly, as illustrated in FIG. 10, the fluid loss valve 20 is rendered unnecessary or redundant by use of the system 10*a*, as the plug 66 and the seat 64 of the work string 22' enable suitable pressurization for setting the packer 28, and the tool 30' of the work string 22' enables control of the barrier valve 26 such that the assembly 24 can completely isolate the lower completion 14. After isolating the lower completion 14, a production string, e.g., the string 54, subsequent intermediate assemblies, etc., can be run in and interact with the assembly 24 as described above.

Figure 11:
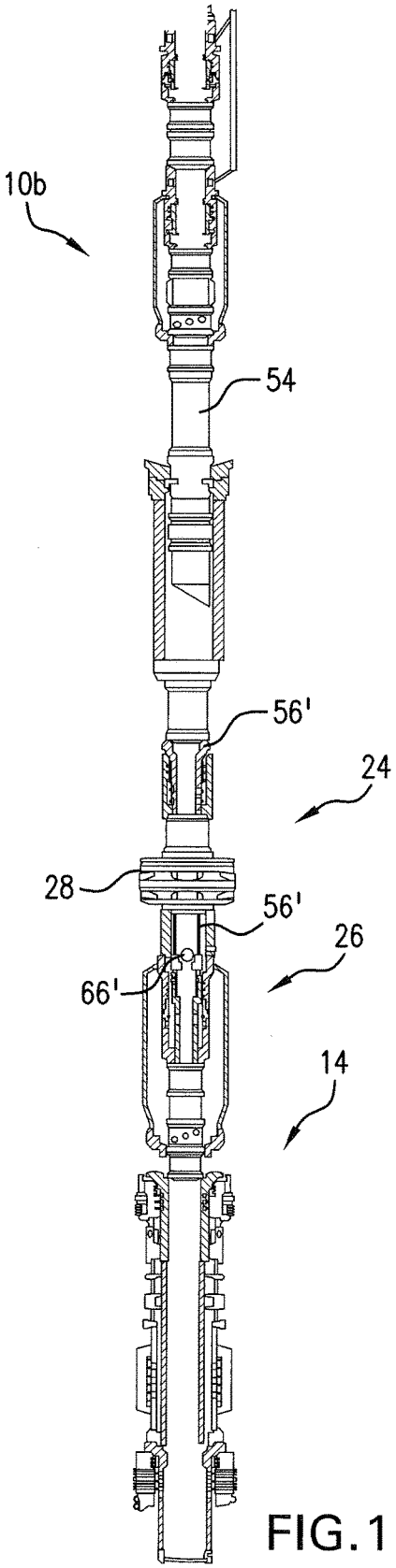
FIG. 11 is a partially cross-sectional view of a completion system according to another embodiment disclosed herein.

As another example, a modified system 10*b* is illustrated in FIG. 11. The system 10*b* is similar to the system 10*a* in that a separate fluid isolation valve for the lower completion 14, e.g., the valve 20, is not necessary and instead the system 10*b* can be run in for initially isolating the lower completion 14. Unlike the system 10*a*, the system 10*b* is capable of being run-in immediately on the production string 54 without the need for the work string 22' of the system 10*a*. Specifically, the system 10*b* is run-in with a plug 66' already located in a shifting tool 56' of the production string 54. The tool 56' resembles the tool 56 with the exception of being arranged to hold the plug 66' therein for blocking fluid flow therethrough. By running the plug 66' in with the system 10*b*, the plug 66' does not need to be dropped and/or pumped from surface, as this would be impossible for various configurations of the production string 54, e.g., if the string 54 includes ESPs or other components or assemblies that would obstruct the pathway of a dropped plug down through the string. The plug 66' is arranged to be degradable, consumable, disintegrable, corrodible, dissolvable, chemically reactable, or otherwise removable so that once it has been used for providing the hydraulic pressure necessary to set the packer 28, the plug 66' can be removed and enable production through the string 54. In one embodiment the plug 66' is made from a dissolvable or reactive material, such as magnesium or aluminum that can be removed in response to a fluid deliverable or available downhole, e.g., acid, brine, etc. In another embodiment, the plug 66' is made from a controlled electrolytic material, such as made commercially available by Baker Hughes, Inc. under the tradename IN-TALLIC®. Once the plug 66' is removed, the system 10*b* would function as described above with respect to the system 10.

It is thus noted that the current invention as illustrated in FIGS. 1-9 is suitable as a retrofit for systems that are in need of a workover, i.e., need to have the upper completion replaced or removed, but already includes a valve resembling the fluid loss valve 20 (e.g., a ball valve or some other type of valve used in the art that requires wireline intervention, hydraulic pressure cycling, the running and/or manipulation of designated shifting tools, etc., in order to transition between open and closed configurations). Alternatively stated, the system 10 enables downhole isolation of a lower completion for performing a workover, i.e., removal or replacement of an upper completion, without the need for time consuming wireline or other intervention.

In view of the foregoing it is to be appreciated that new completions can be installed with a valve, e.g., the fluid loss valve 20, that requires some separate intervention and/or operation to close the valve during workovers, or, alternatively, according to the systems 10*a* or 10*b*, which not only initially isolate a lower completion, e.g., the lower completion 14, but additionally include a barrier valve, e.g., the barrier valve 26, that automatically closes upon pulling out the upper completion, as described above.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A completion system, comprising:

a lower completion installed in a borehole proximate to a downhole formation;

an intermediate completion assembly directly engaged with the lower completion, the intermediate completion assembly including a barrier valve and packer device, the barrier valve operatively arranged to selectively impede fluid flow through the lower completion, the packer device operatively arranged for isolating the formation; and an upper completion string selectably engagable with the intermediate completion assembly, the barrier valve operatively arranged to be transitionable to an open position when engaged with the upper completion string and transitioning to a closed position via the upper completion string when the upper completion string is pulled out of the borehole, wherein the upper completion string is a production string and the production string is run in with a removable plug, the removable plug enabling fluid to be pressurized thereagainst in the production string for setting the packer device.

2. The completion system of claim 1, wherein the production string comprises an artificial lift system.

3. The completion system of claim 1, further comprising a subsequent intermediate completion assembly stacked with the intermediate completion assembly, the subsequent intermediate assembly having a subsequent barrier valve and a subsequent packer device for functionally replacing the intermediate assembly.

4. The completion system of claim 3, wherein the intermediate completion assembly is engaged between the subsequent intermediate completion assembly and the lower completion and the subsequent intermediate completion assembly is engaged between the intermediate completion assembly and the upper completion string.

5. The completion system of claim 4, wherein the upper completion string includes a first tool operatively arranged for enabling the subsequent barrier valve to transition between open and closed positions and the subsequent barrier valve is arranged with a second tool for holding the subsequent barrier valve in an open position while the subsequent intermediate assembly is engaged with the first intermediate assembly.

6. The completion system of claim 1, wherein the lower completion includes at least one assembly for enabling stimulation, hydraulic fracturing, frac packing, gravel packing, or a combination including at least one of the foregoing.

7. The completion system of claim 1, wherein the upper completion includes a tool extendable through the packer device for engagement with the barrier valve of the intermediate completion assembly.

8. The completion system of claim 1, wherein the intermediate completion assembly includes a shroud enclosing a housing of the barrier valve.

9. A method of completing a borehole comprising:

running a lower completion in the borehole proximate to a downhole formation;

engaging an intermediate completion assembly directly with the lower completion;

impeding fluid flow through the lower completion selectively with a barrier valve of the intermediate completion assembly prior to producing through the completion, the barrier valve operatively arranged to be transitionable to an open position when engaged with an upper completion string defining a production string and transitioning to a closed position via the upper completion string when the upper completion string is pulled out of the borehole;

isolating the formation with a packer device of the intermediate completion assembly prior to producing through the completion; and pressurizing against a removable plug run in with the production string in order to set the packer device;

wherein the production string comprises an artificial lift system.

10. The method of claim 9, further comprising removing the removable plug for enabling fluid communication between the upper completion string and the lower completion.

11. The method of claim 9, further comprising pulling out the upper completion string and running in a subsequent upper completion string.

12. The method of claim 11, wherein running in the subsequent upper completion string includes running in a subsequent intermediate completion assembly attached to the subsequent upper completion string, the subsequent intermediate completion assembly having a subsequent barrier valve and a subsequent packer device for functionally replacing the intermediate completion assembly due to engagement therewith.

13. The method of claim 12, wherein the subsequent upper completion string includes a first tool operatively arranged for enabling the subsequent barrier valve to transition between open and closed positions and the subsequent barrier valve includes a second tool for holding the subsequent barrier valve in an open position while the subsequent intermediate assembly is engaged with the first intermediate assembly.

* * * * *